United States Patent [19]

Zocher

[11] 3,998,259

[45] Dec. 21, 1976

[54] DEBURRING AND DIE-SHAPING OF PUNCHED HOLES IN PRECISION MASS PRODUCED PARTS

[75] Inventor: Josef Zocher, Aachen, Haaren, Germany

[73] Assignee: The Singer Company, Elizabeth, N.J.

[22] Filed: Jan. 5, 1976

[21] Appl. No.: 646,726

[52] U.S. Cl. ..... 163/5
[51] Int. Cl.[2] ..... B21G 3/28
[58] Field of Search ..... 163/1, 3, 5

[56] References Cited

UNITED STATES PATENTS

| | | | |
|---|---|---|---|
| 1,103,481 | 7/1914 | Buhren | 163/5 |
| 3,333,623 | 8/1967 | Recknagel et al. | 163/5 |

*Primary Examiner*—Granville Y. Custer, Jr.
*Attorney, Agent, or Firm*—Edward L. Bell; Robert E. Smith; Julian Falk

[57] ABSTRACT

A method of manufacture is disclosed by which punched holes in mass produced parts, such as sewing machine needles and yarn guiding elements for textile machines, can be readily shaped, deburred and polished using die-shaping procedures only.

2 Claims, 5 Drawing Figures

DEBURRING AND DIE-SHAPING OF PUNCHED HOLES IN PRECISION MASS PRODUCED PARTS

BACKGROUND OF THE INVENTION

This invention relates to a method of deburring and polishing punched holes in mass produced parts of steel and other formable metals. The method is particularly well adapted for use in the manufacture of needles for sewing machines.

Several deburring and polishing processes have been used in the past. Chemical or electrolytic deburring and polishing are quite common. In the manufacture of sewing machine needles it is very common to thread the punched eye of the needle on a cotton thread to which emery paste has been added and then the emery-filled thread is placed in a machine specially built for the polishing operation. Deburring can also be accomplished by means of steel brushing.

An example of a method of producing sewing machine needle eyes by means of die-pressing operations is disclosed in the U.S. Pat. No. 3,333,623 issued Aug. 1, 1967. In this patented method the web that remains in the eye after all the die-pressing is completed must be removed by a punch-pin tool. This punch-pin operation does not polish the wall defining the eye. Consequently a separate eye polishing step is required satisfactorily to finish the eye.

While the above mentioned procedures are effective a careful control must be exercised to obtain the required tolerance in the polished eye or hole. Also these various methods require preparation work and subsequent cleaning and, thus, increase the cost of manufacturing.

SUMMARY OF THE INVENTION

It is the primary object of the present invention to provide an improved method for deburring and polishing holes in mass produced parts by the use of die-shaping procedures only.

Another object of the present invention is to provide a method of deburring and polishing holes in mass produced parts by employing a die-shaping tool to finish shape and polish the previously punched holes.

With these and additional objects and advantages in view as will hereinafter appear, this invention will be described with reference to the accompanying drawings of a preferred embodiment, in this case a sewing machine needle.

DESCRIPTION OF THE PREFERRED EMBODIMENT

Figure 1:
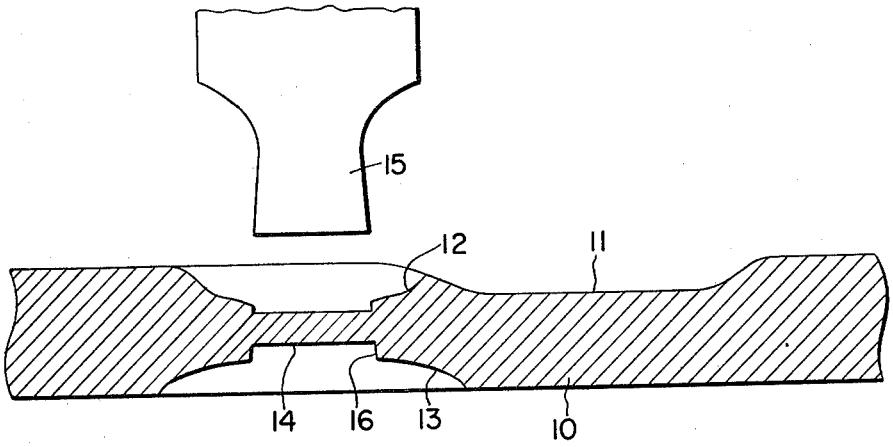
FIG. 1 is a cross section of the eye portion of a sewing machine needle blank which has been subjected to an initial die-pressing operation in preparation for a punch-pin step.

Referring to the drawing the invention is disclosed as embodied in the eye portion of a sewing machine needle 10. It will be understood that while the embodiment chosen to illustrate the invention is a sewing machine needle the improved method forming the subject of the present invention can be used to shape the eye or hole of any implement used in the textile trade in which a thead or yarn traverses the implement.

Referring to FIG. 1 the needle blank 10 as illustrated has been subjected to a series of preliminary die-pressing operations. that have formed the needle blank with the usual scarf 11 and the initial needle eye forming transversely alined cavities 12 and 13 separated by a relatively thin web 14. In the series of progressive manufacturing steps shown in the drawing, the web 14 is removed by the punch-pin 15. The result of this punching process is an eye or hole 16 with burrs on the edges and also remaining rough surfaces defining the hole 16.

Figure 2:
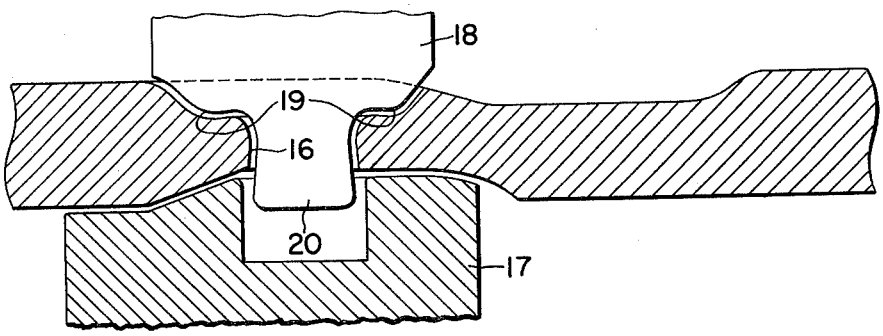
FIG. 2 is a cross section showing the needle blank resting on a lower supporting die and an upper shaping die pressed into the punched hole.

The next step in the manufacturing process is disclosed in FIG. 2 and comprises placing the needle blank 10 on a supporting die 17 and then pressing through the hole 16 a shaping-die tool 18 which resembles a punch-pin. As the shaping-die is pressed downwardly into the needle blank the contours 19 formed in the tool 18 cause the material surrounding the marginal portion of the hole 16 to flow into a shape corresponding to the contours 19 and, at the same time, flow inwardly tightly to embrace the shaping portions 20 of the tool. During the retracting stroke of the tool 18 the shaping portion 20 polishes the rough surface defining the hole 16. From the above it will be realized that by using only a shaping-die tool the upper half of the needle eye is formed accurately and polished by use of die-shaping procedure only.

Figure 3:
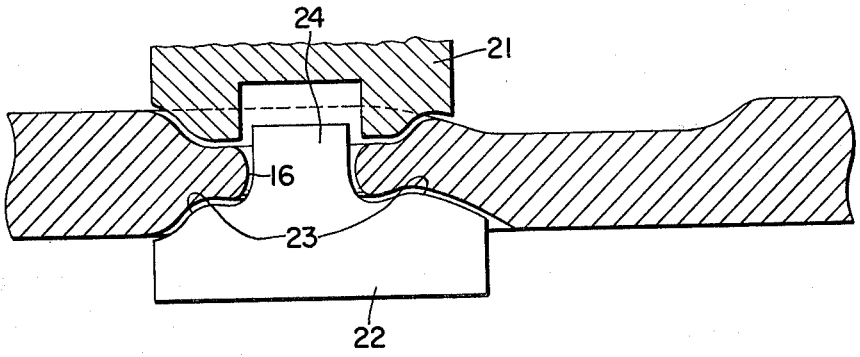
FIG. 3 is a cross section showing the needle blank engaging an upper supporting die and a lower shaping die pressed into the needle blank.

FIG. 3 discloses the step required to finish shape and polish the remaining half of the needle eye. The upper half of the needle eye is placed in contact with a supporting die 21, following which a second shaping-die tool 22 having correct contour surfaces 23 and a projecting shaping portion 24 is pressed into the needle. As in the case of the shaping-die tool 18, the material in the needle flows to conform to the contour surfaces 23 of the tool 22 and also tightly to embrace the projecting shaping portion 24. Retracting of the tool 22 finish polishes that portion of the hole adjacent the lower finished shaped portion of the hole.

Figure 4:
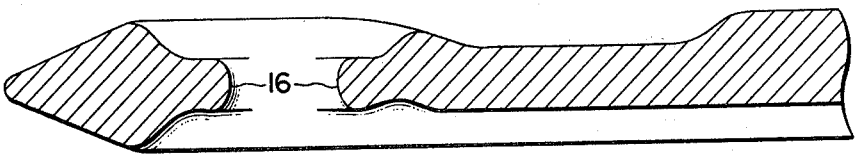
FIG. 4 is a cross section of the finished needle.
Figure 5:
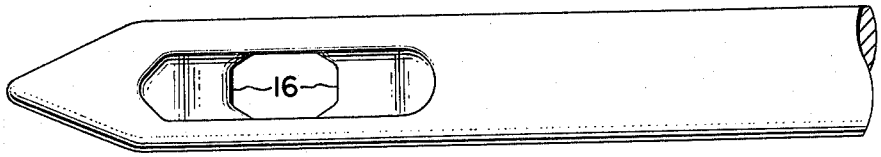
FIG. 5 is an elevational view, showing the shape of the finished eye of the needle.

FIGS. 4 and 5 show views of a needle in which the eye has been produced using die-shaping procedures only. It will be understood that the use of die-shaping procedures not only eliminates the heretofore required deburring operations with their required preparation work and subsequent cleaning costs, but also permits the production of needle eyes having a more desirable geometric shape with the capability of duplicating such shape needle after needle.

Presently, in the manufacture of needles the die-pressing of the needle blanks is effected using rapid production machines, usually operating at some hundred strokes a minute. Die-shaping can be performed following the die-pressing operation on the same machines and at the same speed as the die-pressing is performed.

While a sequence of die-shaping using first an upper shaping-die tool and then a lower shaping-die tool is described, it will be understood that upper and lower shaping-die tools can be employed at the same time, the two tools having shorter polishing projections so that they do not interfere with one another. Should a small burr be present between the adjacent ends of the polishing projections it can be readily removed by a conventional punching-pin.

Numerous alterations of the structure herein disclosed will suggest themselves to those skilled in the art. However, it is to be understood that the present disclosure relates to a preferred embodiment of our invention which is for purposes of illustration only and not to be construed as a limitation of the invention. All such modifications which do not depart from the spirit of the invention are intended to be included within the scope of the appended claims.

Having thus described the nature of the invention, what I claim herein is:

1. A method of finish shaping and polishing the eye portion of a thread handling implement used in textile machinery in which the implement in blank form has been subjected to die-pressing operations whereby the eye portion is provided with initial transversely alined cavities divided by a web portion, comprising the steps of first forming an eye hole by removing said web by means of a punch-pin operation, inserting an eye sizing and polishing projection through said eye hole, maintaining said eyes sizing and polishing projection through said eye hole while pressung shaping die tool into the marginal portions of the initial cavities in the implement eye portion to impart the final geometrical shape to the marginal portions of the eye portion and to displace the eye portion tightly against said eye sizing and polishing projection, and then retracting said eye sizing and polishing projection from said implement to effect a final polishing of the walls defining the surface of the eye hole.

2. A method of finish shaping and polishing the eye portion of a thread handling implement used in textile machinery in which the implement in blank form has been subjected to die-pressing operation whereby the eye portion is provided with initial transversely alined cavities divided by a web portion, comprising the steps of removing said web by means of a punch-pin operation, arranging the thread handling implement with one of its initial cavities resting on a supporting die, pressing a first shaping-die tool into the marginal portion of the opposite initial cavity with an eye sizing and polishing projection formed on the shaping-die tool extending into the eye, withdrawing the shaping-die tool so as to polish the wall defining the surface of the eye, arranging to support the thread handling implement on the now finished shaped initial cavity of the implement, pressing a second shaping-die tool into the marginal portion of the remaining initial cavity with an eye sizing and polishing projection formed on the shaping-die tool extending into the eye, and withdrawing the second shaping-die tool so as to finish polishing the wall defining the surface of the eye.

* * * * *